United States Patent [19]

Tsuda et al.

[11] Patent Number: 4,601,794

[45] Date of Patent: Jul. 22, 1986

[54] METHOD AND APPARATUS FOR CONTINUOUS ELECTROPLATING OF ALLOYS

[75] Inventors: Tetsuaki Tsuda, Nishinomiya; Kazuo Asano, Ibaraki; Atsuyoshi Shibuya, Nagaokakyo; Minoru Nishihara, Kyoto; Kenichi Yanagi, Hiroshima; Mitsuo Kato, Hiroshima; Katsuhiko Yamada, Hiroshima; Teijiro Fujisaka, Hiroshima, all of Japan

[73] Assignees: Sumitomo Metal Industries, Ltd., Osaka; Mitsubishi Jukogyo Kabushiki Kaisha, Tokyo, both of Japan

[21] Appl. No.: 647,738

[22] Filed: Sep. 6, 1984

[30] Foreign Application Priority Data

Sep. 7, 1983 [JP] Japan ..... 58-165795
Dec. 8, 1983 [JP] Japan ..... 58-230610

[51] Int. Cl.[4] ..... C25D 5/04; C25D 17/00; C25D 21/10

[52] U.S. Cl. ..... 204/15; 204/28; 204/206

[58] Field of Search ..... 204/28, 206, 207, 208, 204/209, 210, 211, 15

[56] References Cited

U.S. PATENT DOCUMENTS

| | | | |
|---|---|---|---|
| 2,317,242 | 4/1943 | Allen et al. | 204/206 |
| 2,673,836 | 3/1954 | Vonada | 204/28 |
| 3,420,760 | 1/1969 | Freedman et al. | 204/211 X |
| 3,644,181 | 2/1972 | Donaldson | 204/15 |
| 4,313,802 | 2/1982 | Shibuya et al. | 204/28 |
| 4,434,040 | 2/1984 | Brendlinger | 204/206 |

*Primary Examiner*—G. L. Kaplan
*Attorney, Agent, or Firm*—Burns, Doane, Swecker and Mathis

[57] ABSTRACT

A method and apparatus of continuous electroplating of a strip with an alloy by passing the strip through a plating bath of the immersion type in both down-pass and up-pass with an anode being positioned in each pass so as to face at least one side of the strip are disclosed. Said anode is an insoluble anode which is spaced from the strip by a distance of about 10–50 mm, and the plating solution is blown into the gap between said anode and said strip countercurrently with respect to the movement of said strip.

20 Claims, 20 Drawing Figures

METHOD AND APPARATUS FOR CONTINUOUS ELECTROPLATING OF ALLOYS

BACKGROUND OF THE INVENTION

The present invention relates to a method and apparatus for continuous electrodepositing of alloys (e.g. Zn-Ni and Zn-Fe alloys) on steel strips.

Steel strips with electroplated coatings of alloys such as Zn-Ni and Zn-Fe alloys are capturing the attention of manufacturers of automobiles, consumer's electrical appliances and construction materials largely because of their good properties such as high corrosion resistance, good compatibility with paints, high press-formability and good weldability. Intensive efforts are being made to commercialize the process of electroplating these alloys, and they have revealed that the principal problem facing commercial alloy plating is how to provide alloy platings of the most uniform composition on steel strips in the largest quantities and at the lowest cost.

The manufacture of steel strips with electroplated alloy coatings generally involves the following problems. (1) In continuous alloy electroplating of steel strips, fluctuation in operating variables cause variations in the composition of the plated alloy and this is often reflected adversely in the quality of the final plating. In particular, if there occurs a change in the distribution of the flow rate of the plating solution at the interface with the work in the cell, variations occur in the composition of the plated alloy, the type of the deposited phase of the alloy, and even in the size or shape of the electrodeposited crystal grains of the alloy and the internal stress in the plated film, and this causes instability in the properties of the plated alloy, which are undesirable for practical purposes.

The distribution of the flow rate of the plating solution varies with the travelling speed of the work. In the actual plating operations, the travelling speed of the work varies unavoidably over a fairly wide range, and as a result, the variations in the distribution of the flow rate of the plating solution are virtually unavoidable.

For these reasons, it has generally been understood that alloy plated steel strips having uniform and consistent performance are inherently difficult to obtain. (2) The recent increases in the capital costs for the construction of electroplating equipment have been so rapid that commercial platers are trying to cope with this problem by minimizing the overall plating length as defined by the number of plating cells times the effective plating length per cell. One approach is to practice plating operations at high current density in each cell.

(i) In the practice of plating operations at high current density, if the distribution of the flow rate of the plating solution at the interface with the work is not uniform, the plated film, whether it is made of a single metal or an alloy, is usually in the form of a dendrite or powdered deposit (commonly called "burnt deposit") and does not have a high degree of smoothness or adhesion to the work. Furthermore, in the practice of high current density plating operations, the flow rate of the plating solution has a certain proper range, and unlike the case of plating of a single metal such as zinc, higher flow rates do not necessarily ensure the best results. More specifically, the distribution of the flow rate of the plating solution determines the final composition of the plated film and the type of the precipitating phase. For example, in the plating of Zn-Ni (5–20 wt % Ni) or Zn-Fe (10–40 wt % Fe) alloys, an excessively small flow rate causes a powdery plate rather than a burnt deposit. If the flow rate is too fast, the plated film has the $\eta$ phase which impairs its corrosion resistance and weldability.

(ii) If a soluble anode is used in the high current density operation, rapid consumption of the anode necessitates frequent replenishing of the consumed part or even frequent replacement of the entire anode. This causes a prolonged shutdown period and an increase in personnel and cost for replacement operations, which eventually leads to decreased productivity and increased overhead expenses. The use of a soluble anode presents an additional problem peculiar to alloy plating, i.e., difficulty in the control of the composition of the plating bath. For the reasons mentioned above, most of the practical alloy platers operating at high current density are using an insoluble anode.

(iii) However, none of the presently available materials are ideal for use as an insoluble anode. Precious metals (e.g. Pt, Ru, Ir and Au) and their oxides, or lead-base alloys containing at least one element selected from among Ag, Sn, Sb, In, Tl, Hg, As, Sr, Ca and Ba are currently used as insoluble anode materials. Anodes made of precious metals or their oxides are expensive and are used only for plating on electronics materials such as lead frames, and in the plating on steel strips, anodes made of lead alloys is used exclusively. However, this type of anode gradually dissolves in an acidic plating solution as a result of chemical reaction or electrolytic oxidation, and a $PbO_2$ film formed on the anode surface comes off the anode in particles during the plating operation. The loose $PbO_2$ particles adhere to the surface of the work and cause "dent marks" as the work is passed between conductor rolls. This is responsible for low yield in the final plating products (iv) The use of an insoluble anode in plating at high current efficiency causes another problem. Large volumes of oxygen bubbles evolve at the anode and hydrogen bubbles at the cathode (work) surface. Unless these bubbles are rapidly removed from between the electrodes, the plating voltage is increased or the metal film is deposited unevenly or its composition is subject to significant variations.

As shown above, the manufacture of steel strips with electroplated alloy coatings involves various problems and this prevents an expanded use of such strips in spite of the many advantages they have.

While various methods or apparatus have been proposed for use in electroplating operations at high current density, they have their own merits and demerits, as shown below.

(1) Japanese Patent Public Disclosure No. 210984/1982 and Japanese Patent Publication No. 8020/1975 show a plating apparatus of the type depicted in FIG. 1; this apparatus comprises a horizontal plating cell 1 having insoluble anodes 2, 2 formed on the inner surface of both top and bottom walls, and a plating solution is blown into the cell through supply nozzles 3, 3 in a direction opposite to the direction in which the steel strip S travels as indicated by the arrow. This apparatus has some effectiveness in providing a fast and uniform flow rate of the plating solution at the interface with the strip and for preventing the formation of a burnt deposit at high current density. However, gases evolved at the anode 2 and the strip S cannot be sufficiently removed from the small gap therebetween, and $PbO_2$ particles and other materials that come off the anode surface unavoidably cause the formation of dent marks on the surface of the strip. As a further disadvantage, the anode 2 is an integral part of the inner walls of the rectangular plating cell 1, and this presents appreciable difficulty in repairing the anode which is not "insoluble" in the strict sense and which will gradually wear away in the long run.

(2) Japanese Patent Publication No. 18167/1978 shows a plating method and apparatus of the type shown in FIG. 2; the apparatus includes anodes 2, 2 positioned in a face-to-face relation with the strip S and treating compartments 4, 4 disposed on the back side of the anodes, each anode being provided with a plurality of holes 5 (two holes in the embodiment shown) through which a plating solution is blown onto the strip S in the direction indicated by the arrows. As in the case of FIG. 1, the apparatus shown in FIG. 2 ensures an increased mass transfer to the strip surface and is effective for preventing the formation of burnt deposit and for removing gases evolved between the electrodes. However, the flow of the plating solution being blown normally to the strip S forms an impinging jet stream in the neighborhood of the point where the plating solution strikes the strip. This causes an uneven distribution of mass transfer in the transversal or longitudinal direction of the strip S, and in the case of Zn-based alloy plating, the electrodeposited phase is so affected as to increase the chance of formation of a plated film containing the $\eta$ phase. As already mentioned, the formation of the $\eta$ phase is deleterious to the corrosion resistance of the final alloy plated steel strip.

(3) Japanese Patent Publication No. 14759/1982 shows a plating method and apparatus of the type shown in FIGS. 3(*a*) and 3(*b*); the apparatus includes an anode 2 that is positioned to face the strip S and which is provided with nozzles 6 in the form of, for example, slit holes which extend widthwise on the anode and through which the plating solution is squirted at high speed against the strip. Technically, this method is based on the same concept as that of the apparatus shown in (2) and cannot be practiced without forming an uneven distribution of the flow rate of the plating solution in the longitudinal direction of the electrodes. If, as shown in FIG. 3(*b*), a plurality of nozzles 6 through which the plating solution is blown in a direction opposite to the direction in which the strip S travels as indicated by the arrow are arranged in the longitudinal direction of the anode, jets of the plating solution interfere with each other as shown by the arrow heads with dashed lines, and this provides the combination of counter flows and cross flows. The transverse currents flow at an extremely low speed in the horizontal direction in FIG. 3(*b*), but on the other hand, the flow rate at the point where the plating solution impinges on the strip immediately after it is issued from the nozzle 6 is excessively high. As a result, the composition and the electrodeposited phase of the plated alloy film become uneven not only in the longitudinal direction but also in the transverse direction. Furthermore, the thickness of the electrodeposit is unavoidably non-uniform in oblique directions where the counter flows are combined with the cross flows.

The vertical plating cell shown in FIG. 3(*a*) has an additional problem; because of gravitational force, it is difficult to keep a jet of the plating solution in contact with the strip S and considerable difficulty is involved in holding the plating solution between the anode 2 and the strip S. This problem is particularly notable on the down-pass side $X_1$ where a downward drag flow of the plating solution forms due to the descent of the strip. Even if this problem could be avoided, the volume of the plating solution that is necessary to fill the gap between the anode and strip on the downpass side $X_1$ would greatly differ from that required on the up-pass side $X_2$, causing a significant difference between the two passes with respect to the distribution of the flow rate of the plating solution at the interface with the strip. Therefore, with the apparatus shown in FIG. 3(*a*), an alloy plate cannot be deposited in a uniform thickness.

The plating systems shown in FIGS. 1 to 3 are common in that a jet of the plating solution is impinged against the strip surface. In this jet plating system, the plating solution supplied between the anode 2 and the strip S drops into a receiving tank in the form of a large quantity of splash. If the plating solution contains easy-oxidizable ions, for example, $Fe^{2+}$ ions (as in the case of Zn-Fe alloy plating), $Fe^{2+}$ ions are aerially oxidized to $Fe^{3+}$ions, with the result that the concentration of $Fe^{3+}$ ions in the plating solution is increased. The large quantity of splash that continuously drops into the receiving tank has a corrosive action on parts associated with the plating cell, such as the roll drive motor, position detecting instruments, bus bars and carbon brushes on conductor rolls. Furthermore, the splash can endanger the operators working at the plating cell.

Another problem with the jet plating system is that a partial negative pressure develops in the neighborhood of the point where the jet of the plating solution impinges against the strip and increases the chance of ambient air being entrapped in the form of bubbles. If the plating solution contains $Fe^{2+}$ ions, this air entrapping accelerates oxidation of $Fe^{2+}$ ions to $Fe^{3+}$ ions.

A system that could be called "circulation of plating solution in immersion type cell" is shown in literature. This system comprises an immersion type Zn plating cell using an insoluble or soluble anode, and occasionally an ascending flow of plating solution is supplied from the bottom of the cell, thereby providing uniformity in the operating variables of the plating solution such as concentration, temperature and pH. However, this system is intended for the plating of Zn rather than its alloy, and is not based on the concept that a mass transfer should be controlled as uniformly as possible in an area adjacent to the strip surface. The distribution of the flow rate of the plating solution on the strip surface differs not only between the down-pass side and the up-pass side but also between one surface and the opposing surface of the strip. Furthermore, part of the plating solution does not flow in a countercurrent fashion with respect to the travel of the strip. Therefore, this system has not been considered to be capable of providing an alloy electroplate with a uniform thickness and uniform alloy composition in a continuous manner.

SUMMARY OF THE INVENTION

One object of the present invention is to provide a method and apparatus for alloy electroplating that has solved all of the problems with the conventional techniques and which is capable of continuous production of steel strips having alloy electroplates of consistent quality.

Another object of the present invention is to provide a continuous alloy electroplating apparatus that ensures the formation of an electroplated coating with a good quality by using a nozzle that supplies a countercurrent of plating solution with respect to the movement of the strip and which is so configured that the distribution of the flow rate of the plating solution becomes uniform over the strip surface.

On the basis of various experiments, the present inventors concluded that an immersion type plating cell is indispensable to obtaining a uniform distribution of the flow rate of the plating solution. This conclusion has led the inventors to the idea of using a vertical cell rather than the conventional horizontal type, and the inventors have found that the stated objects of the present invention can be accomplished in an advantageous manner by using this type of cell. The present invention has been accomplished as a result of this finding.

The present invention resides in method of continuous electroplating of a strip with an alloy by passing the strip through a plating bath of the immersion type in both down-pass and up-pass with an anode being positioned in each pass so as to face at least one side of the strip, wherein said anode is an insoluble anode which is spaced from the strip by a distance of 10–50 mm, the plating solution being blown into the gap between said anode and said strip countercurrently with respect to the movement of said strip.

Furthermore, the present invention resides in a continuous alloy electroplating apparatus including a vertical cell for a plating solution and insoluble anodes immersed in said plating solution, said insoluble anodes being vertically positioned on at least one side of and spaced from a strip running through a down-pass and an up-pass which are within the plating solution for defining the anode plating area, the improvement wherein said apparatus further includes a means for blowing the plating solution into the gap between the strip and each anode countercurrently with respect to the movement of the strip, said means being positioned in at least either one of said down and up-passes at an end where the strip leaves said anode plating area defined by either pass.

According to the present invention, a vertical plating cell having insoluble anodes immersed in the plating solution is used. In both down and up passes, the plating solution is blown in a direction opposite to the movement of the strip, and the resulting distribution of the flow rate of the plating solution is uniform for each pass in the direction of the movement of the strip and is substantially the same for each pass. Furthermore, quite unexpectedly, the distribution is not highly dependent upon the line speed of the strip (the distribution does not change greatly with variations in the line speed). These features are highly favorable to stable deposition of the desired alloy electroplate.

According to the present invention, the anodes are completely immersed in the plating solution, and this eliminates the need for employing a special step of filling the gap between the anode and strip (cathode) with the plating solution. Furthermore, the plating solution will not splash from between the electrodes, and at the same time, no problem will occur that is associated with the entrapping of air in the neighborhood of the point at which a jet of the plating solution issuing from nozzles impinges on the strip. The use of a vertical immersion type plating cell has additional advantages: gas bubbles evolved between electrodes rise by buoyancy and are discharged out of the system spontaneously; very few dent marks occur even if $PbO_2$ particles and other materials come off the anodes. With the vertical plating cell used in the present invention, the strip is supported by conductor rolls on the top of the cell, and sink rolls in the cell can be used simply as guide rolls, which also serve as deflector rolls. Therefore, the sink rolls may by made of rubber which is soft enough to minimize the formation of dent marks in the strip surface due to particles coming off the anodes.

Keeping the distance between electrodes constant is very important for reliable and continuous operations of plating on steel strips. According to the present invention, the work is hung vertically and is free from deflection due to its own weight, unlike the catenary shape formed for horizontal cell. This permits a precise setting of the separation gap between the strip and the anode (interelectrode spacing).

According to one embodiment of the present invention, said means for blowing the plating solution is preferably composed of a supply header in a conduit form which is positioned substantially parallel to the strip and transverse to the direction of its movement, a plurality of orifices which are formed in at least one row in the surface of said header in its longitudinal direction, an impingement plate that is positioned on said header and extends along the header in the longitudinal direction thereof and against which the plating solution squirted from said orifices impinges, and a guide plate positioned on the header at an angle with respect to the longitudinal direction thereof and which is arranged at a suitable position between adjacent of said orifices.

The plating method and apparatus of the present invention are basically intended for plating of Zn-Ni and Zn-Fe alloys, but they are also applicable to the plating of other Zn alloys such as Zn-Ni-Fe, Zn-Co-Cr, Zn-Cr, Zn-Mn, and Zn-Ti, as well as non-zinc alloys such as Sn-Cu, Sn-Pb, Fe-Zn, Fe-Ni and Fe-Sn alloys.

BRIEF DESCRIPTION OF THE DRAWINGS

FIG. 3(*b*) is a diagram illustrating the distribution of the flow rate of plating solution between anodes used in the equipment shown in FIG. 3(*a*);

FIG. 5(*b*) is a diagram showing the distribution of the flow rate of plating solution on the strip surface when the plating solution is blown in a contercurrent fashion;

DETAILED DESCRIPTION OF THE PREFERRED EMBODIMENTS

Figure 4:
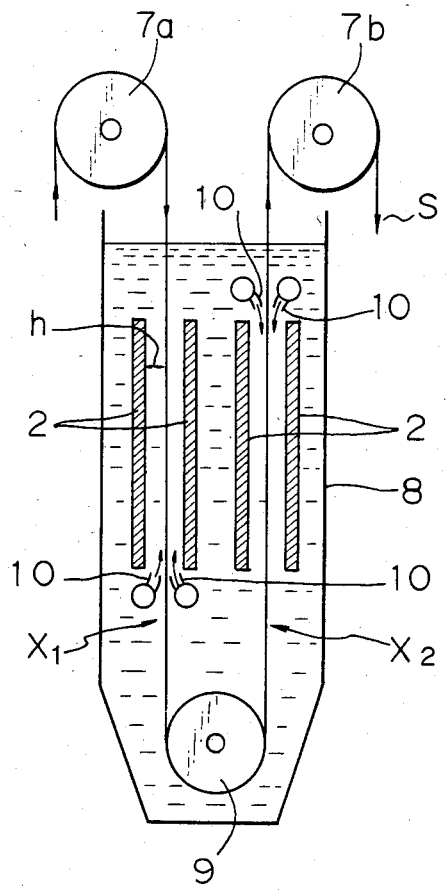
FIG. 4 is a side-elevational section showing a continuous alloy electroplating apparatus using an immersion type vertical plating cell according to the invention.

FIG. 4 is a side cross-sectional view of the immersion type vertical plating cell used in the present invention. The basic configuration of this vertical cell is as follows: a strip S passing over a conductor roll 7*a* on the entry side is introduced into a plating bath in the plating cell 8 (this provides a down-pass $X_1$) and after it passes over a sink roll 9 in the bath, the strip is pulled up (along an up-pass $X_2$) and is drawn out of the cell via a conductor roll 7*b* on the exit end. Plating is performed with two sets of anodes 2, 2, one set consisting of two anodes positioned on both sides of and spaced apart from the strip S in the down-pass $X_1$ and the other set consisting of two anodes also positioned on both sides of and spaced apart from the strip in the up-pass $X_2$.

According to the present invention, a nozzle 10 that supplies the plating solution in a direction opposite to the movement of the strip is provided in at least either one of the down-pass or up-pass at a point where the strip leaves the anodes. If both sides of the strip are to be electroplated, this nozzle 10 is provided on both sides of the strip as shown in FIG. 4. Preferably, the nozzle 10 is positioned in both down-pass and up-pass at the point where the strip leaves the anodes. For the reasons stated later in this specification, the interelectrode spacing (the distance between anode and cathode) is set at about 10–50 mm.

Though not shown, the plating solution recovered from the cell may be re-conditioned for its bath composition and temperature. Furthermore its pressure can be boosted by a pump (not shown) before it is recycled to the plating cell. An edge masking means (not shown) may be provided for both opposing end portions of the strip.

As already mentioned in connection with the description of the prior art, the behavior of alloy electroplates deposited in the vertical cell is also governed by the distribution of the plating solution in the neighborhood of the interface with the strip (cathode). Stated more specifically, electrodeposition of alloy plate is strongly affected by the gradient of flow velocity of the plating solution at the interface with the strip in reference to a moving coordinate system set on the traveling strip, said gradient $\alpha_{y=0}$ being expressed by:

$$[d/dy|V_F-V_S|]_{y=0}$$

wherein y: the normal distance from the strip surface as taken in the direction toward the anode (i.e., indicating the position between anode and cathode);

$V_F$: the velocity vector indicating the distribution of the flow velocity of the plating solution between electrodes;

$V_S$: the vector of the traveling speed of the strip.

The distribution of the flow rate of plating solution is a factor that influences the behavior of alloy being electroplated on the strip, and the most convenient and precise quantity that represents this distribution would be the relative speed $V_R$ which is given by:

$$V_R=V_{Fm}-V_S$$

wherein $V_{Fm}$ is the flow rate of the plating solution at a point near the strip surface where the absolute value of gradient $\alpha$ of the flow rate approaches infinity. Here, $$\alpha=\partial/\partial y|V_F-V_S|.$$

Figure 5:
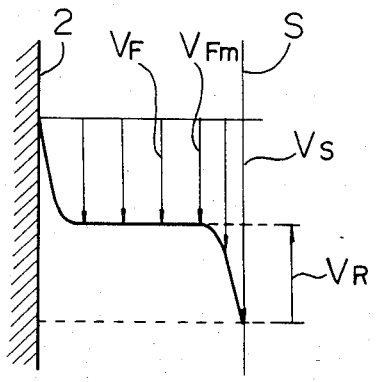
FIG. 5(*a*) is a diagram showing the distribution of the flow rate of plating solution on the strip surface within the immersion type vertical plating cell when no plating solution is blown against the strip.
Figure 5:
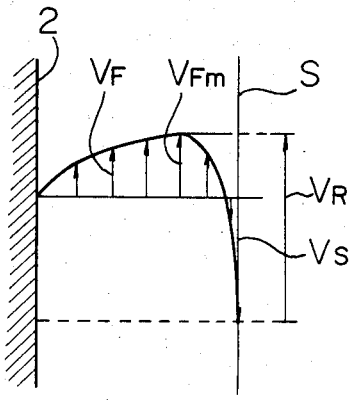

FIG. 5 show the flow velocity profile of the plating solution in the immersion type vertical cell; FIG. 5(*a*) refers to the case where no plating solution is injected against the strip, and FIG. 5(*b*) shows the case where the plating solution is blown in a direction opposite to the movement of the strip. In FIG. 5, the symbol S indicates the strip, and numeral 2 indicates the anode. FIG. 5(*a*) and 5(*b*) show velocity vectors that are indicated by $V_R$ and which have the definition given above. Whether the plating solution is blown against the strip or not, the direction of the velocity vector is countercurrent with respect to the movement of the strip and its magnitude ($|V_R|$) is the sum of $V_S$ which is the absolute value of the traveling speed of the strip and $V_{Fm}$ which is the maximum speed of the counter flow of the plating solution near the strip surface (the sign of $V_{Fm}$ is positive if the solution flows countercurrently and negative if it flows concurrently).

Figure 6:
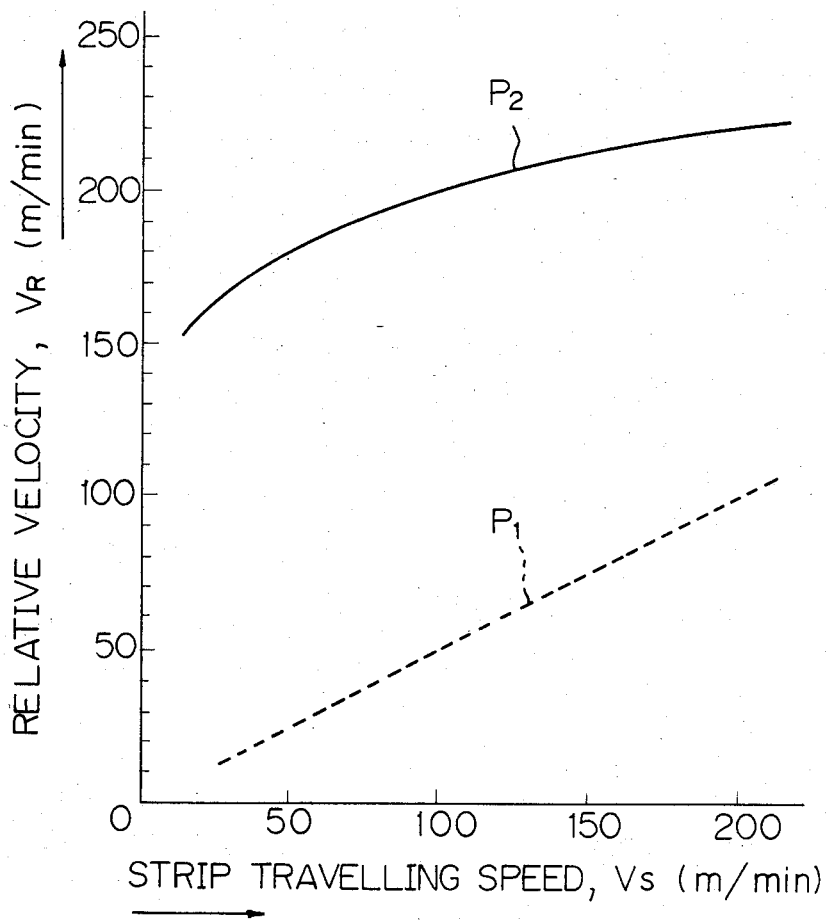
FIG. 6 is a graph showing the line speed ($V_S$) versus the flow rate of the plating solution relative to the strip for the case of FIG. 5(*b*)

An experiment was conducted with an electroplating line using the immersion type vertical cell according to the present invention shown in FIG. 4; the results are shown in FIG. 6 with respect to the relation between the relative velocity $V_R$ and the travelling speed of the strip (line speed $V_S$). In FIG. 6, $P_1$ shows the case where no plating solution was blown against the strip, and $P_2$ refers to the case where the plating solution was injected countercurrently at a flow rate of 2 $m^3$/min.

In the absence of injection of the plating solution ($P_1$), relative speed $V_R$ increased linearly with increasing line speed $V_S$. Unexpectedly, however, in the case of blowing the plating solution at 2 $m^3$/min($P_2$), the relative speed was fairly stable in the range of practical line speeds (50–200 m/min). A probable reason for this phenomenon would be as follows: when the electrolyte is injected, the flow of plating solution that is dragged by the moving strip increases with the increase in the line speed $V_S$, and this tends to decelerate the plating solution blown countercurrently, thereby reducing the velocity $V_F$ of the plating solution flowing between electrodes in the countercurrent fashion. Thus, the relative speed $V_R$, given by the formula: $V_{Fm}-V_S$, is kept fairly stable. Whatever the reason, it would be understood that the counter flow injection of the plating solution into the immersion type vertical cell is effective in stabilizing the distribution of the flow rate of the plating solution regardless of variations in the line speed of the strip.

Figure 7:
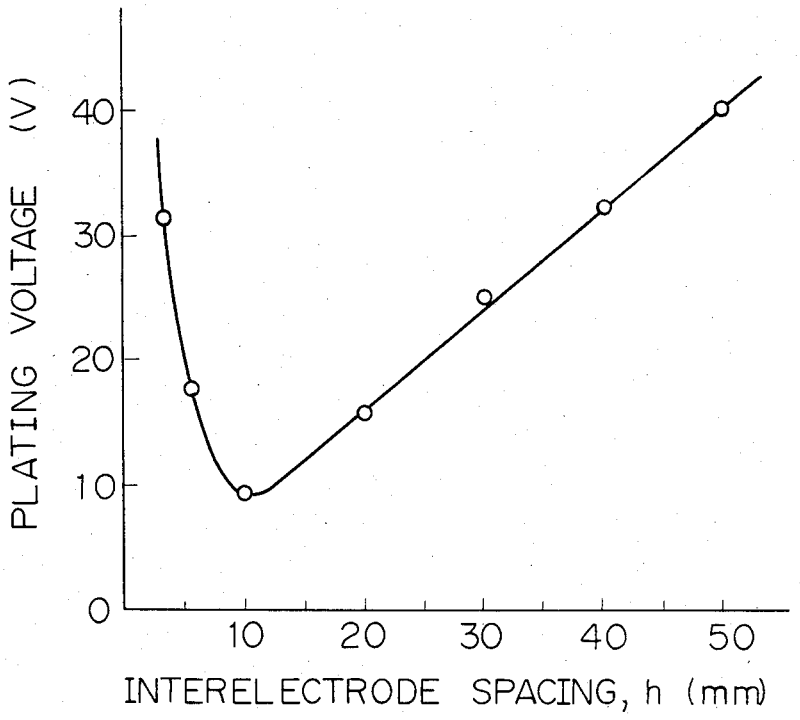
FIG. 7 is a graph showing the separation spacing between anode and strip (interelectrode spacing) (h) vs. the plating voltage (V) for the case of FIG. 5(*b*)

FIG. 7 is a graph showing the interelectrode spacing (h) vs. the plating voltage, as obtained by an experiment wherein a cold-rolled coil (strip thickness: 0.4 mm, width: 300 mm) was electroplated with a Zn-Ni alloy in the apparatus shown in FIG. 4 with varying interelectrode spacings (h) while the plating solution was blown countercurrently in both down-pass ($X_1$) and up-pass ($X_2$). In this experiment, the following electrolytic conditions were used.

Plating bath

Composition: $(Ni^{2+})/(Zn^{2+})$ in a molar ratio of 2.0–2.5;

Temperature: 60° C.;

pH: 2;

Current density: 120 A/dm$^2$;

Plating solution blown at: 0.1 m$^3$/min

Line speed: 20–200 m/min.

FIG. 7 shows that the plating voltage increased rapidly when the interelectrode spacing was less than 10 mm. This is because the density of gas bubbles evolved between electrodes is so high that ascending flow generated by buoyancy force is insufficient to purge gas bubbles from the separation gap. More specifically, with interelectrode spacings of less than 10 mm, even a vertical plating cell that will permit gas bubbles to detach easily from the electrodes and go up to the surface of the plating bath is limited with respect to its ability to cause spontaneous removal of gas bubbles. As a result, various disadvantages occur such as increased plating voltage, uneven deposition of alloy plate, the formation of pinholes, and variations in the composition of the electroplated alloy film.

On the other hand, if the distance between electrodes exceeds 50 mm, the voltage loss due to an increase in electrical resistance of the plating solution approaches an economically undesirable level. Furthermore, the longer the distance between electrodes, the greater the amount of the plating solution that must be blown against the strip, and this necessitates the use of a larger-capacity pump for supplying the plating solution. Therefore, it is not advisable for achieving the purposes of the present invention to use an interelectrode spacing larger than 50 mm.

It is essential for the purpose of the present invention that the plating solution be injected in between electrodes in a countercurrent direction with respect to the movement of the strip. The term "countercurrent" excludes not only the concurrent flow but also a flow that impinges substantially perpendicular to the strip surface.

By blowing the plating solution into the gap between the anode and strip, the velocity of the flow of the plating solution is combined with the velocity of the travelling strip, thereby promoting the flow of the plating solution. At the same time, by controlling the supply of the plating solution, the velocity $V_R$ of the plating solution relative to the strip speed can be controlled. The term "counter flow" as used in this specification should include not only a counter flow which is perfectly parallel to the movement of the strip but also a slightly divergent counter flow, as well as a slightly convergent counter flow.

Figure 8A:
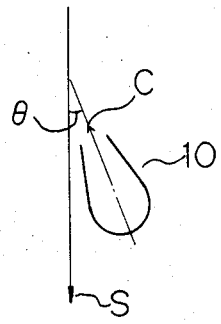
FIG. 8(*a*) and FIG. 8(*b*) show two examples of the position of nozzles relative to the strip according to the present invention.
Figure 8B:
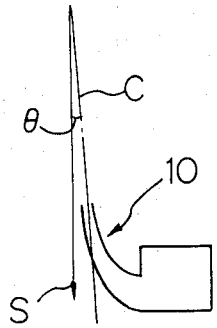
Figure 9A:
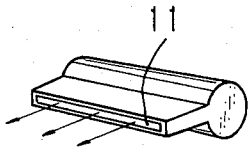
FIG. 9(*a*), 9(*b*) and 9(*c*) are perspective views showing three embodiments of the countercurrent forming nozzles used in the present invention.
Figure 9C:
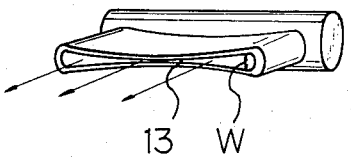
Figure 9B:
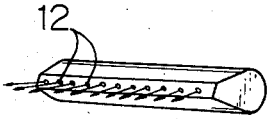

Two examples of the layout for the strip and the nozzle through which the plating solution is blown according to the present invention are shown in FIG. 8. In order to ensure a uniform distribution of the flow rate of the plating solution, it is preferred that the direction in which the plating solution is countercurrently blown (as indicated by C in FIG. 8(*a*)) is substantially parallel to the direction of the movement of the strip S. In other words, better results are obtained if the angle $\theta$ between the axis of the nozzle and the strip is as small as possible. In actual operations, however, the wear of the nozzle due to contact with the strip S and the limited space of equipment installation must be considered and practically the angle $\theta$ may be not larger than 60°, preferably within the range of about 15°–60°. For the purpose of reducing this angle $\theta$, a nozzle 10 in the form of a bird's beak as shown in FIG. 8(*b*) is effective and recommended for use in the practice of the present invention. Most commonly, the opening of the nozzle is in the form of a rectangular slit 11 as shown in FIG. 9(*a*). Other usable forms of the nozzle opening include a plurality of circular slots 12 arranged side by side as shown in FIG. 9(*b*), and FIG. 9(*c*) shows a slit 13 whose width W changes gradually in the longitudinal direction. The nozzle opening may assume any other forms so long as they ensure a uniform distribution of the flow rate of the plating solution across the width of the strip S.

Figure 10:
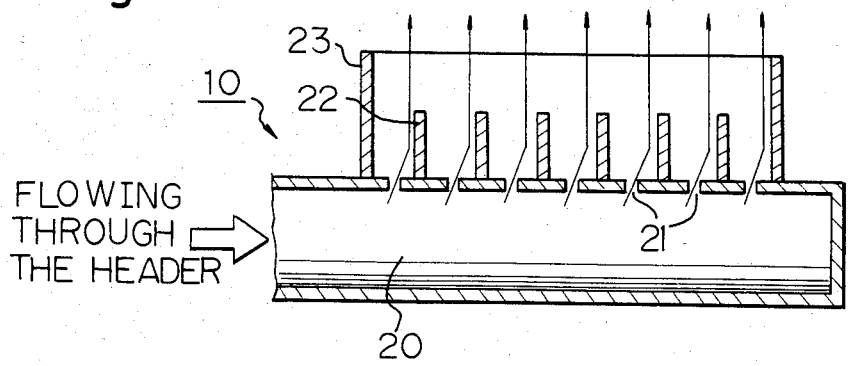
FIG. 10(*a*) and 10(*b*) are schematic sections showing one embodiment of the nozzle that can be used in the apparatus of the present invention.
Figure 10B:
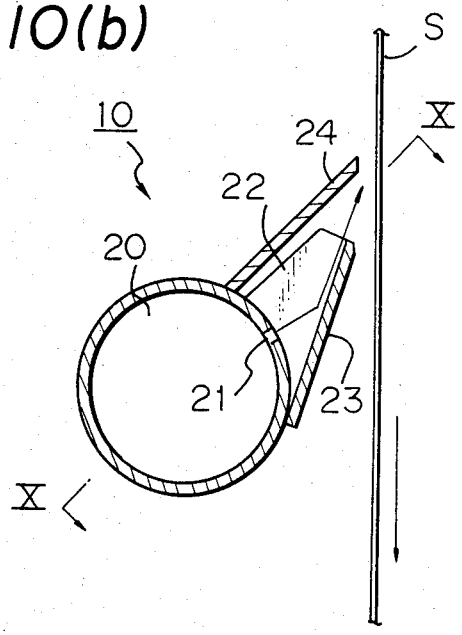

FIG. 10(*a*) and 10(*b*) show schematically one embodiment of the nozzle configuration that may be used with particular advantage in the present invention. The nozzle 10 comprises a header 20 which is provided with a plurality of orifices 21 at suitable spacings (equally spaced in the embodiment shown). Guide plates (partitions) 22 are erected on the header at points between adjacent orifices 21. FIG. 10(*a*) is a section of FIG. 10(*b*) taken along line X—X. In the embodiment shown, the nozzle opening through which the plating solution is blown consists of a series of orifices rather than in the form of a slit, and this configuration is effective in providing a uniform distribution of the flow rate of the plating solution by removing those components of the velocity of the plating solution which are parallel to the axis of the header. More specifically as shown in FIG. 10(*a*), when the plating solution is blown against the strip through orifices 21, the components of the velocity of the plating solution flowing through the header in the direction indicated by the open arrow are removed by impingement on the guide plates 22. As a result, the plating solution is caused to flow in one direction only, so the speed of the plating solution relative to the strip surface is increased and a uniform distribution of the flow rate of the plating solution is obtained in the direction parallel to the axis of the header. This ensures the efficient manufacture of steel strips having an electrodeposit of good quality formed uniformly in the axial direction of the header (transverse to the length of the strip).

As is better illustrated in FIG. 10(*b*), the header 20 is also provided with an impingement plate 23 against which the plating solution blown through the orifices 21 impinge, so as to form a wall jet in the radial direction which is effective in minimizing variations in the velocity of the plating solution in the axial direction of the nozzle (header) and in providing a highly uniform distribution of the flow rate of the plating solution in the transversal direction of the strip. The angle between the strip S and the impingement plate 23 along which the plating solution is ejected is preferably not larger than 60°. In the embodiment shown, the impingement plate 23 is disposed on the line of the orifices and at an angle with respect to the outer periphery of the header. FIG. 10(*b*) also includes a rectifying plate 24 which minimizes the effects the plating solution around the nozzle may have on the plating solution being blown against the strip.

The orifices 21 may be formed in two rows which are spaced apart from each other. The guide plate 22 may be curved rather than straight as shown in FIG. 10(*b*).

Figure 11A:
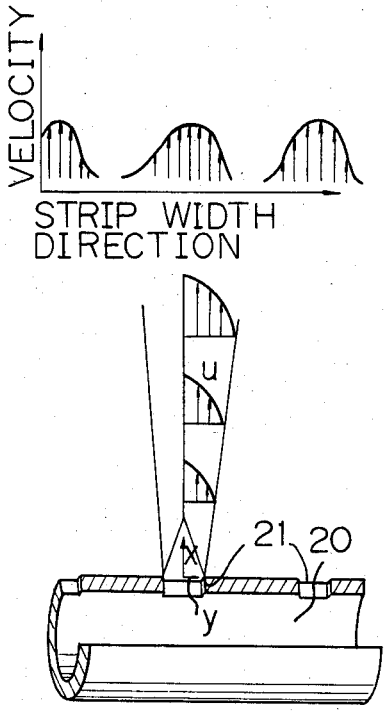
FIG. 11(*a*) and 11(*b*) are schematic diagrams showing the distributions of the flow rate of plating solution obtained by using the nozzle shown in FIG. 10.
Figure 11B:
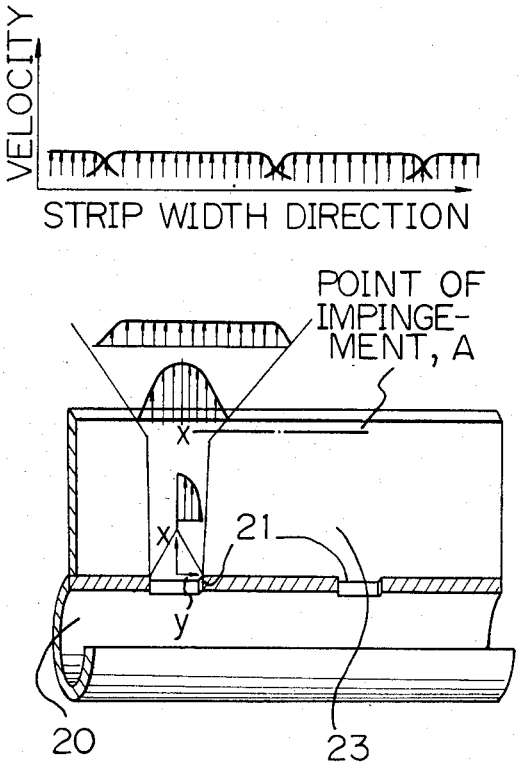

FIG. 11(*a*) shows a profile of the distribution of the velocity of blown plating solution in both x- and y-directions for the case where the impingement plate 23 is not used. As is clear from this Figure, the velocity distribution spreads gradually in the y-direction as the distance from the orifice 21 increases in the x-direction. FIG. 11(*b*) shows a profile of the distribution of the velocity of blown plating solution in both x- and y-directions for the case where the impingement plate 23 is used. As one can see from this Figure, the velocity distribution changes in a manner similar to that shown in FIG. 11(*a*) until the blown plating solution impinges on the plate 23. When the plating solution impinges on the plate 23 at point A, there occurs a sudden increase in the number of velocity components of jet in the y-direction, and a uniform distribution of the flow rate of the blown plating solution is obtained across the width of the strip.

The plating solution that issues from the orifices 21 and which impinges on the plate 23 forms a wall jet and is distributed uniformly when it later impinges on the strip, as illustrated in FIG. 11(*b*) wherein the velocity of the plating solution and the distance along the length of the header (or across the strip) are plotted on the vertical and horizontal axes, respectively. As shown in FIG. 11(*b*), in case the impingement plate 23 is provided on the nozzle, the plating solution blown through the orifices 23 impinges on the plate 23 and is distributed radially from the nozzle, so that the velocity of the plating solution at orifices 21 and that of the plating solution between orifices 21 becomes sufficiently small to provide a uniform distribution in velocity across the width of the strip. As a result, the plating solution is supplied uniformly to the surface of the strip to ensure the formation of an electrodeposit of good quality.

Figure 2:
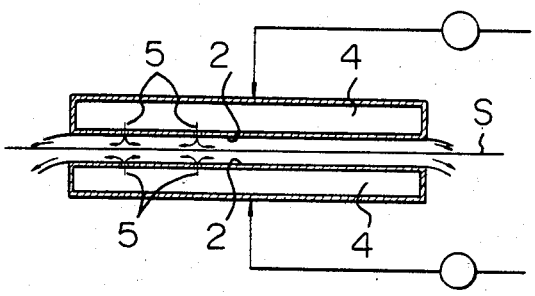
Fig. 2 PRIOR ART
FIG. 2 is a schematic diagram of a horizontal plating cell wherein a jet of the plating solution is supplied from the anode side to impinge against the strip surface.
Figure 3A:
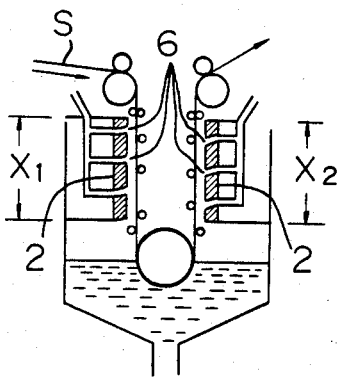
Fig. 3(a) PRIOR ART
FIG. 3(*a*) is a schematic elevational section of plating equipment using a non-immersion type vertical plating cell.
Figure 3B:
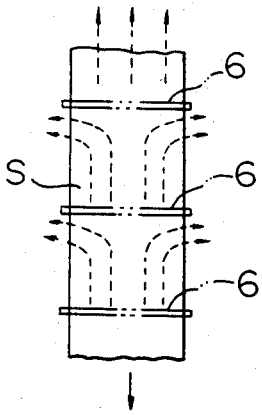
Fig. 3(b) PRIOR ART

As will be apparent from the foregoing description, the present invention wherein the plating solution is blown countercurrently in an immersion type vertical cell provides a stable relative velocity between the strip to be plated and the plating solution blown countercurrently regardless of variations in the line speed of the strip. The present invention also provides an appreciably stable and uniform distribution of the flow rate of the plating solution as compared with the conventional jet impingement techiniques shown in FIGS. 2 and 3 which involve the formation of transversal flows or local vortices. Furthermore, this uniform velocity distribution can be achieved by simply employing the header herein disclosed, which comprises a plurality of orifices, an impingement plate and guide plate. It is therefore possible to manufacture alloy plated steel strips of consistent quality by the present invention.

The advantages of the present invention are hereunder described in greater detail by reference to working examples, to which the scope of the invention is by no means limited.

EXAMPLE 1

A cold-rolled coil (strip thickness: 0.4 mm, width: 300 mm) was electroplated with a Zn-Ni alloy in the apparatus of the present invention using an immersion vertical cell of the type shown in FIG. 4 with varying line speeds. Two runs of experiment were conducted; in one run, the plating solution was blown at 3 $m^3$/min countercurrently through nozzles 10, 10 in both down-pass $X_1$ and up-pass $X_2$, and in the other experiment, no such blowing of the plating solution was effected. In both runs, the following electrolytic conditions were used and the nozzle configuration was as shown in FIG. 9(*a*).

Plating bath

Composition: $(Ni^{2+})/(Zn^{2+})$ in a molar ratio of 2.0–2.5;

Temperature: 60° C.;

pH: 2;

Current density 60–120 A/$dm^2$;

Interelectrode spacing: 25 mm.

Figure 12:
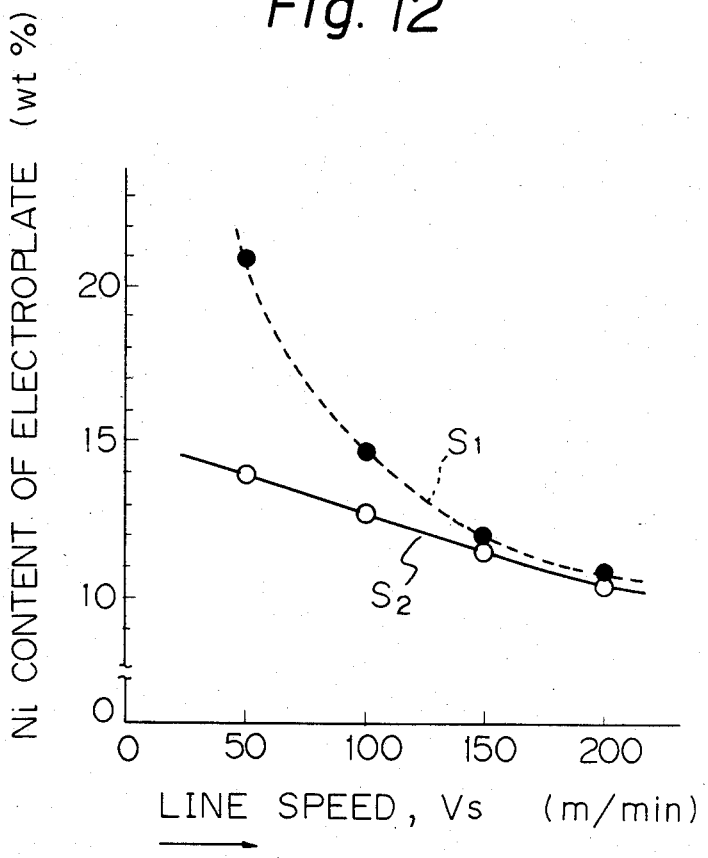
FIG. 12 is a graph showing the line speed vs. the Ni content of the Zn-Ni alloy coat electrodeposited on steel strips according to the present invention and the conventional method.

The Ni content of the electroplate formed in each of the strip samples was checked by chemical analysis, and the results are shown in FIG. 12. When no plating solution was blown against the strip (curve $S_1$), the composition of the electrodeposit varied greatly with the changing line speed. At low line speeds, the composition was a mixture of the $\Gamma$ and $\alpha$ phases. When the plating solution was blown against the strip countercurrently (curve $S_2$), Zn-Ni electroplates of the $\Gamma$ phase having a stable Ni content and which were considered to have substantially the same composition were obtained regardless of the change in the line speed.

EXAMPLE 2

A coil of thin steel strip (thickness: 0.3 mm, width: 250 mm) was electroplated with a Zn-Fe alloy (deposit: 20 g/$m^2$) as in Example 1 using the apparatus shown in FIG. 4 except that the plating solution was blown at 6 $m^3$/min and the electrolytic conditions were modified to the following.

Platinq bath:

Composition: $(Fe^{2+})/(Zn^{2+})$ in a molar ratio of 1.0–2.5;

Temperature: 50° C.;

pH: 2.0;

Current density: 50–150 A/$dm^2$.

The plated steel strips were checked for the non-powderiness of the electroplate to discern their press-formability.

ANTI-POWDERING TEST;

Adhesive tape was attached to the plated surface of a test piece 50 mm wide and 200 mm long. The test piece was bent 180° about a round bar 10 mm in diameter and rebent to its original straight form. The adhesive tape was detached and the amount of loose particles of the plate that adhered to the tape was measured. Samples having very few loose particles of the plate that adhered to the tape were rated "good".

Figure 13:
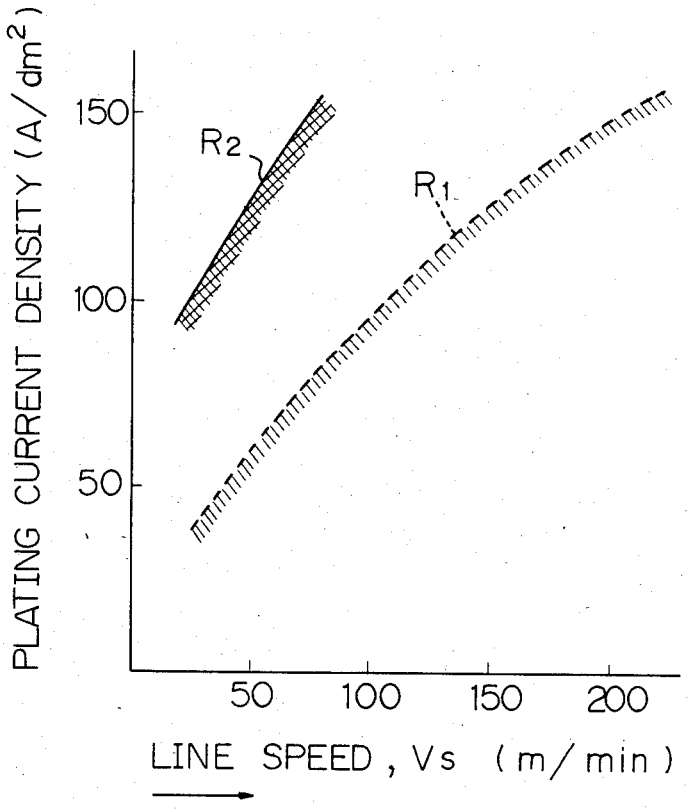
FIG. 13 is a graph showing the line speed vs. current density in connection with the anti-powdering properties (i.e., formability) of the Zn-Fe alloy coating that was electroplated on steel strips either by the present invention or by the conventional method.

Those ranges of the plating current density and line speed which provided good results in the anti-powdering test are depicted in FIG. 13; in the Figure, the hatched area below the dashed line $R_1$ refers to the region ensuring good results in the anti-powdering test when no plating solution was blown against the steel strip, and the hatched area below the solid line $R_2$ shows the region ensuring good test results when the plating solution was blown countercurrently. The general tendency of Zn-Fe alloy plating is that a powdery coat results if the current density is high and the line speed is low. FIG. 13 shows that a counter flow of the plating solution blown against the strip within an immersion type vertical cell is highly effective for stabilizing the performance of the electroplated film of a Zn-Fe alloy.

Figure 1:
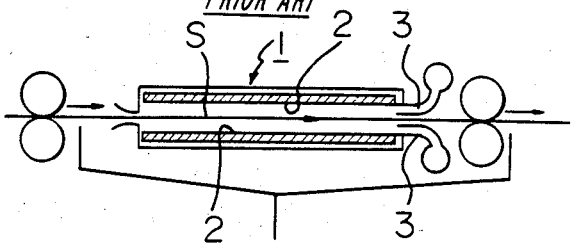
Fig. 1 PRIOR ART
FIG. 1 is a schematic diagram of a horizontal plating cell which supplies the plating solution in a countercurrent fashion with respect to the movement of the strip.

In Examples 1 and 2, the rate of the aerial oxidation of $Fe^{2+}$ ions to $Fe^{3+}$ ions in the plating bath was not higher than 0.1 kg/hr, and it was very easy to maintain the plating bath in stable conditions. In another experiment conducted by the present inventors, the rate of aerial oxidation to $Fe^{3+}$ ions was as high as 1-3 kg/hr when the plating cell was of the non-immersion horizontal type shown in FIG. 1, and the rate increased to even higher levels (5-10 kg/hr) when the plating cell was of the vertical non-immersion type shown in FIG. 3(*a*).

As shown above, the present invention enables the continuous manufacture of alloy electroplated steel strips having consistent quality, and hence is expected to make a great contribution to manufacturing various types of alloy electroplated steel strips with a better quality and in higher yields.

Although the invention has been described with preferred embodiments, it is to be understood that variations and modifications may be employed without departing from the concept of the invention as defined in the following claims.

What is claimed is:

1. In a continuous alloy electroplating apparatus including a vertical cell for a plating solution and insoluble anodes immersed in said plating solution, said insoluble anodes being vertically positioned on at least one side of and spaced from a strip running through a down-pass and an up-pass which are within the plating solution for defining the anode plating area, the improvement wherein said apparatus further includes a means for blowing the plating solution into the gap between the strip and each anode countercurrently with respect to the movement of the strip, said means being positioned in at least either one of said down-pass and up-pass at an end where the strip leaves said anode plating area defined by either pass, said means for blowing the plating solution being composed of a supply header in a conduit form which is positioned substantially parallel to the strip and transverse to the direction of its movement, a plurality of orifices which are formed in at least one row in the surface of said header in its longitudinal direction, an impingement plate that is positioned on said header parallel thereto and extends along the header in the longitudinal direction thereof and against which the plating solution squirted from said orifices impinges, and a guide plate positioned on the header at an angle with respect to the longitudinal direction thereof and which is arranged at a position between adjacent of said orifices.

2. An apparatus according to claim 1 wherein said orifices are arranged in two rows.

3. An apparatus according to claim 1 wherein said guide plate is so curved as to surround said orifices.

4. An apparatus according to claim 1 wherein said header has an outer periphery and wherein said impingement plate is disposed at an angle with respect to the outer periphery of said header.

5. An apparatus according to claim 1 wherein said guide plate is mounted vertically on said header.

6. An apparatus according to claim 1 wherein a plurality of guide plates are positioned on the header and said guide plates are disposed at equal distances along the longitudinal direction of the header.

7. An apparatus according to claim 1 wherein said means for blowing the plating solution is disposed so that said impingement plate has an angle of not more than 60° with respect to the strip surface.

8. In a method of continuously electroplating a metal strip of extended length with an alloy by continuously immersing said metal strip in a plating solution bath, said metal strip being immersed in said bath first in a downward and then in an upward directed run of the strip, the improvement comprising:

using an electroplating anode of an insoluble material which is located opposite at least one side of each of said downward and upward directed runs of the strip to form a gap falling substantially within a range of from 10 to 55 mm between said anode and each of said runs of the strip, an electroplated area of said strip being defined by a portion of each run of the strip facing said gap; and blowing a plating solution at a predetermined rate into said gap in a direction substantially opposite to a movement of said strip in the run of the strip facing the gap, thereby forming a flow of the plating solution to the movement of the strip, said flow in a counter direction forming a substantially stable relative velocity with respect to said run of the strip facing the gap.

9. A method according to claim 8 wherein the anodes are positioned to face both sides of the runs of the strip.

10. A method according to claim 8 wherein the plating solution is blown into the gap formed between the anode and the downward run of the strip.

11. A method according to claim 8 wherein said alloy comprises an alloy selected from the group consisting of Zn-Ni and Zn-Fe alloys.

12. An apparatus for continuously electro-plating a metal strip of extended length with an alloy, comprising:

a vertical cell adapted for containing a plating solution;

means for forwarding and immersing the strip in said plating solution in said vertical cell, said means comprising means for forwarding the strip in the solution first in a downward directed run and then in an upward directed run of the strip;

an anode of an insoluble material opposing each of said downward and upward directed runs of the strip to form a gap in each of said downward and upward directed runs; and blowing means for blowing a plating solution at a predetermined rate into said gap in a direction substantially opposite to a movement of said strip in the run of the strip facing the gap, thereby forming a flow of the plating solution of substantially stable relative velocity with respect to said run of the strip facing the gap, said blowing means being positioned at an end of at least one of the gaps at which end the strip leaves said electroplated area.

13. An apparatus according to claim 12 wherein said blowing means comprises a nozzle through which the plating solution is blown countercurrently in a direction substantially parallel to the movement of the strip.

14. An apparatus according to claim 13 wherein the angle between the axis of said nozzle and the strip is not larger than 60°.

15. An apparatus according to claim 12 wherein said insoluble anode is positioned on each side of the downward and upward directed runs of the strip.

16. An apparatus according to claim 15 wherein said blowing means is positioned on each side of one of the downward and upward directed runs of the strip.

17. An apparatus according to claim 12 wherein said blowing means is positioned at least at an end of a gap defined by the downward directed run of the strip.

18. An apparatus according to claim 12 wherein said blowing means is positioned at ends of gaps at which the strip leaves the electroplated areas in the downward and upward directed runs of the strip.

19. An apparatus according to claim 12 wherein an edge masking means is provided for both edges of the strip facing the gap.

20. An apparatus according to claim 12 which further includes a mechanism for circulating the plating solution in the cell.

* * * * *